United States Patent [19]

Andrews

[11] 4,034,826

[45] July 12, 1977

[54] SILENCER FOR VENTILATION DUCTS

[75] Inventor: John S. Andrews, Barry, England

[73] Assignee: H. H. Robertson Company, Pittsburgh, Pa.

[21] Appl. No.: 597,259

[22] Filed: July 18, 1975

[51] Int. Cl.[2] ..... F01N 1/24

[52] U.S. Cl. ..... 181/36 B; 24/270; 98/DIG. 10; 138/149; 181/42

[58] Field of Search ..... 98/50; 138/149; 181/33 K, 35 C, 41–50, 33 GB, 33 H, 33 P, 36 R, 36 B, 36 D, 62; 24/270; 292/256.69, DIG. 49

[56] References Cited

U.S. PATENT DOCUMENTS

| | | | |
|---|---|---|---|
| 2,287,867 | 6/1942 | Daiger | 181/42 |
| 2,552,847 | 5/1951 | Farr et al. | 181/42 X |
| 2,804,095 | 8/1957 | Schauenburg | 98/50 X |
| 2,958,387 | 11/1960 | Greff | 181/42 |
| 3,097,410 | 7/1963 | Lincoln | 24/270 |
| 3,564,671 | 2/1971 | Straus | 24/270 |
| 3,633,956 | 1/1972 | Angell | 292/256.69 |

FOREIGN PATENT DOCUMENTS

| | | | |
|---|---|---|---|
| 2,062,687 | 6/1972 | Germany | 181/42 |

*Primary Examiner*—Lawrence R. Franklin
*Attorney, Agent, or Firm*—Harry B. Keck; George E. Manias

[57] ABSTRACT

A silencer having a tubular configuration which can be interposed in a duct and form a part of the duct walls. The silencer has an inner perforate wall and an outer imperforate wall. The annular space between the two walls is filled with acoustical sound absorbing materials. The outer imperforate wall is adapted for quick opening to permit easy replacement of the sound absorbing materials.

4 Claims, 3 Drawing Figures

SILENCER FOR VENTILATION DUCTS

BACKGROUND OF THE INVENTION

1. Field of the Invention:

This invention relates to silencers sometimes referred to attenuators of the type interposed in ducting of ventilation systems such as the ventilating and air cleaning systems employed in coal mines. The purpose of the silencer is to reduce the acoustical energy generated from such ducting.

2. Description of the Prior Art:

The silencers of the prior art have a tendency to become choked with deposited foreign matter and to become ineffective for sound attenuating purposes. The prior art silencers can be replaced in a lengthy, costly procedure but cannot be easily repaired without replacement.

SUMMARY OF THE INVENTION

The present silencer permits rapid replacement of clogged sound absorbing material. The silencer has a generally tubular configuration with a cross-section corresponding to the duct in which it is to be interposed. The silencer includes an inner perforate wall, an outer perforate wall or cover spaced apart from the inner perforate wall. Sound absorbing elements are provided in the annular space between the inner wall and the outer wall. The outer wall has a flexible nature or a hinged nature and includes at least one openable joint which is secured by quick release means. The inner perforate wall may be composed of expanded metal or perforated metal sheeting. The outer wall may be of rubber or plastic coated fabric such as asbestos cloth or glass fiber cloth. The outer wall alternatively may be two or more rigid metal sheets which are hingedly connected and separable from the ducting.

The sound absorbing elements comprise pads or mats of a suitable open cell foamed plastics material or pads or mats of mineral wool or glass fiber. When the outer wall of the silencer is removed or opened, the fouled and blinded sound absorbing elements can be easily replaced.

BRIEF DESCRIPTION OF THE DRAWING(S)

DESCRIPTION OF THE PREFERRED EMBODIMENT(S)

Figure 1:
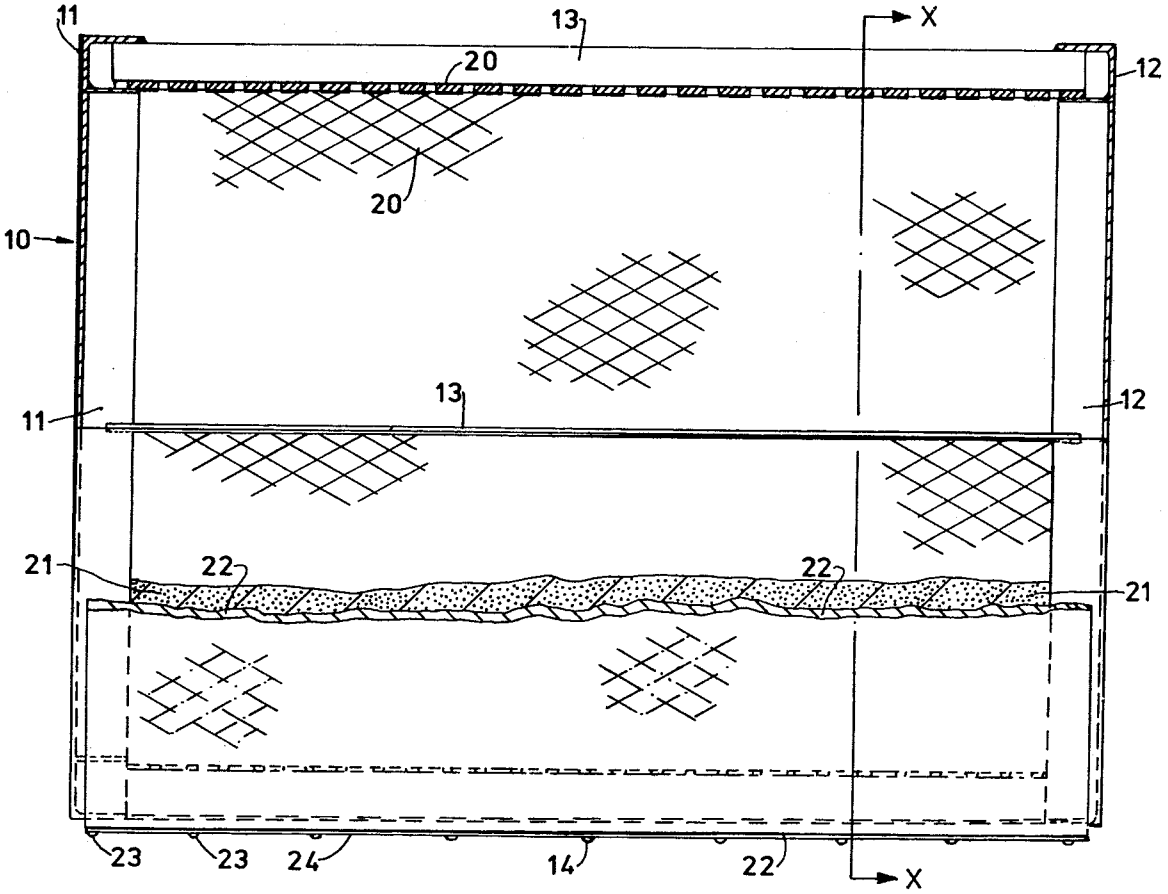
FIG. 1 is a partly sectional elevation of a silencer according to the invention.

A silencer 10 is customarily interposed in the ducting of a ventilating system of the type employed in coal mines. The silencer 10 comprises a pair of terminal flanges which constitute inwardly facing generally channel section end rings 11, 12 which are connected one to the other in parallel by uniformly spaced frame members 13, 14. Three frame members 13 are shown consisting of mild steel strips of appropriate length, width and thickness welded to the end rings 11, 12. The frame member 14 is an angle section having one flange disposed radially and the other chordwise of the outer walls of the channel section end rings 11, 12. The end rings 11, 12 are drilled and tapped or are provided with screw threaded elements 15 (FIG. 2) to receive flange connection bolts of duct work in which the silencer assembly is to be interposed. Tack welded to the frame members 13, 14 and ring members 11, 12 is an inner tubular wall 20 of perforate sheet metal such as expanded metal.

Figure 2:
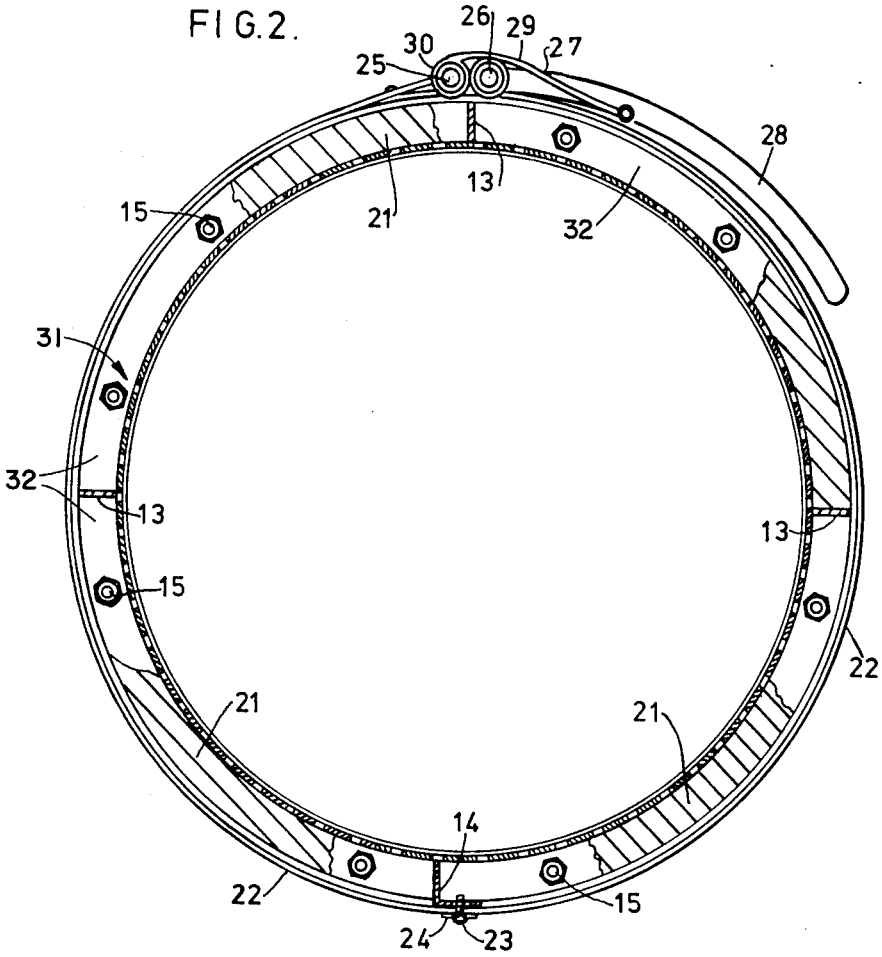
FIG. 2 is a cross-sectional view taken along the line X—X of FIG. 1.
Figure 3:
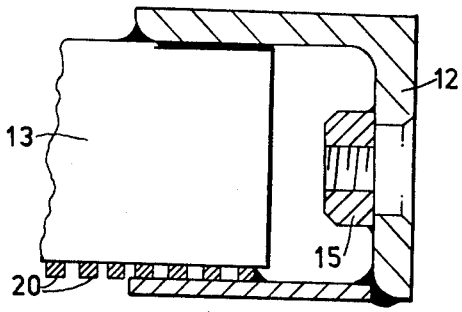
FIG. 3 is an enlarged fragmentary view of a portion of FIG. 1 showing some details which do not appear in FIG. 1.

The inner wall 20 supports sound absorbing elements 21 such as pads or slabs of open celled foamed plastics material or asbestos fibers or glass fibers. The sound absorbing elements 21 are disposed in each of the annular segments 32 between support frame members 13, 14 and are held in an operable position by an outer cover 22. The outer cover as shown is composed of a plastic coated fabric such as asbestos cloth or glass fiber cloth. As best shown in FIG. 2, the spacer members 13, 14 are disposed in the annular space 31 between the inner tubular wall or cylinder 20 and an annularly spaced outer cylinder or cover 22. The spacer members 13, 14 are spaced-apart from each other circumferentially of the inner cylinder 20 and divide the annular space 31 into plural annular segments 32. The outer cover 22 is secured medially to the outer flange of frame member 14 by means of screws 23 which extend through a clamping strip 24. The free ends of the cover 22 are secured in any suitable manner to transverse rods 25, 26 arranged for connection to each other by one or more toggle connectors 27.

The toggle connectors 27 each comprising handle lever 28 pivotally connected at one end to one of the rods 26 and a bifurcated hook member 29 pivotally connected to the lever 28. A head 30 of the hook member 29 releasably engages an exposed part of the other rod 25.

In FIG. 2 the lever 28 is shown in its over center, locked position wherein the ends of the outer cover 22 are pulled tightly into abuttment and the cover 22 is stretched tautly around the assembly.

In order to remove the sound absorbing elements 21 for replacement or cleaning it is merely necessary to release the toggle handle lever 28, turn back the flexible cover 22, remove the fouled elements, insert replacement elements and refasten cover 22. No extrinsic tools are required. The silencer assembly remains mounted in operable position.

In place of the toggle connection 27 it is feasible to employ quick release pliable straps such as leather straps having quick release buckle connections.

I claim:

1. An acoustic silencer of the type interposed in ventilating duct systems comprising in combination: a perforate rigid inner cylinder; an annularly spaced outer cylinder; a ring flange secured peripherally at each end of the said inner perforate cylinder; structurally rigid spacer members disposed in the annular space between the said inner cylinder and the said outer cylinder and secured to the said ring flanges and extending substantially parallel to the axis of the said inner perforate cylinder, the said spacer members being spaced-apart from each other circumferentially of the said inner cylinder and dividing the said annular space into plural annular segments; sound absorbing elements disposed in each of the said annular segments and being retained in operable relation relative to the said inner cylinder by the said outer cylinder; said outer cylinder being secured to one of the said spaced members and having at least one operable joint extending between the said ring flanges; and a quick-release closure for retaining the said operable joint in a closed position.

2. The acoustic silencer of claim 1 wherein the said outer cylinder is fabricated from fabric.

3. The acoustic silencer of claim 1 wherein the said outer cylinder terminates along the said operable joint in parallel rigid rods which can be brought into abutment along a line extending between the said ring flanges; and wherein said quick-release closure comprises toggle clamp means including a handle which is pivotally connected to one of the said rods and a toggle connector member releasably and pivotally engaged with the other of the said rods at one end and pivotally connected to a point intermediate of the said handle at its other end.

4. The acoustic silencer of claim 1 wherein the said one of said spacer members comprises an angle having one flange disposed radially of the said ring flanges and the other flange disposed chordwise of the said ring flanges and spaced from the said inner cylinder.

* * * * *